US011186783B2

(12) United States Patent
Matza

(10) Patent No.: US 11,186,783 B2
(45) Date of Patent: Nov. 30, 2021

(54) OPTIMIZATION OF A METHOD FOR ISOLATION OF PARAFFINIC HYDROCARBONS

(71) Applicant: TriStar PetroServ, Inc., Houston, TX (US)

(72) Inventor: Stephen D. Matza, Houston, TX (US)

(73) Assignee: HPC PetroServ, Inc., Deer Park, TX (US)

( * ) Notice: Subject to any disclaimer, the term of this patent is extended or adjusted under 35 U.S.C. 154(b) by 0 days.

(21) Appl. No.: 14/987,530

(22) Filed: Jan. 4, 2016

(65) Prior Publication Data

US 2017/0190986 A1 Jul. 6, 2017

(51) Int. Cl.

| | |
|---|---|
| ***C10G 33/04*** | (2006.01) |
| ***C10G 21/27*** | (2006.01) |
| ***C10G 33/08*** | (2006.01) |
| ***C10G 21/30*** | (2006.01) |

(52) U.S. Cl.

CPC ..... *C10G 33/04* (2013.01); *C10G 21/27* (2013.01); *C10G 21/30* (2013.01); *C10G 33/08* (2013.01)

(58) Field of Classification Search

CPC ..... C10L 1/326; C10L 1/328; C01B 17/92; C10G 33/04; C10G 49/24; C10G 49/18; C10G 49/22; C10G 17/04; B01D 12/00

See application file for complete search history.

(56) References Cited

U.S. PATENT DOCUMENTS

2008/0169222 A1* 7/2008 Ophus ..... C10G 1/047 208/390
2010/0025300 A1* 2/2010 Nemana ..... C10G 33/04 208/188
2015/0218920 A1* 8/2015 Qunitero ..... E21B 21/00 166/300

OTHER PUBLICATIONS

Cha, C. Y., & Guffey, F. D. (Aug. 1987). Recycle oil pyrolysis and extraction of tar sand. In Proceedings: The Fourth UNITAR/UNDP Internation Conference on Heavy Crude and Tar Sands (vol. 5, p. 10). Alberta Oil Sands Technology and Research Authority. p. 453.*

Kotlyar, L. S., Ripmeester, J. A., Sparks, B. D., & Woods, J. (1988). Comparative study of organic matter derived from Utah and Athabasca oil sands. Fuel, 67(11), 1529-1535.*

* cited by examiner

*Primary Examiner* — Youngsul Jeong
(74) *Attorney, Agent, or Firm* — Tumey L.L.P.

(57) ABSTRACT

A method and composition for isolating a paraffinic hydrocarbon layer from a sludge comprising paraffinic hydrocarbons, water, and solids. The method includes contacting the sludge with isopropylamine dodecylbenzene sulfonate, a cutter stock, and water. The isopropylamine dodecylbenzene sulfonate comprises a concentration of at least 1500 ppm. The ratio of sludge:cutter:water is at least 4:2:1. The method also includes determining if the sludge has separated into a three phase separation comprising a paraffinic hydrocarbon layer, a water layer, and a layer of settled solids.

18 Claims, 2 Drawing Sheets

OPTIMIZATION OF A METHOD FOR ISOLATION OF PARAFFINIC HYDROCARBONS

BACKGROUND OF THE INVENTION

Field of the Invention

This invention relates to the field of industrial facility cleanup and oil extraction, and, more specifically, a method to optimize the isolation of paraffinic hydrocarbons from crude oil tanks containing the paraffinic hydrocarbons.

Background of the Invention

During production, crude oil may be produced that contains dissolved waxes or paraffins. The solubility of high-molecular weight paraffin is related to temperature. When the temperature of the crude oil, or fluid in which the paraffin is dissolved, is lower than the wax precipitation temperature, the paraffin wax may precipitate and deposit under these environmental conditions. The precipitated paraffin wax may form stable wax crystals that deposit on the surfaces of equipment. When the crude oil is refined, the fractional distillation may separate one fraction of hydrocarbons from the paraffinic hydrocarbons. As a part of the process, the remaining fraction containing the paraffinic hydrocarbons may contain solids and water.

The paraffinic hydrocarbons may exist as sludge and may be stored in crude oil tanks, which are sometimes referred to as waxy crude oil tanks. The paraffinic hydrocarbons are a valuable commodity, yet the purification and separation of the paraffinic hydrocarbons from the solids and the water may be difficult, and the costs may exceed the value of the volume of the paraffinic oil.

Previous approaches to remove the paraffinic hydrocarbons have included heating the sludge deposits, dissolving them with chemical solvents, or modifying the ability of the wax to undergo crystal formation using polymeric wax crystal modifiers. Such approaches, however, do not isolate the paraffinic hydrocarbons, but merely remove them from surfaces and/or stop deposition. The valuable paraffinic hydrocarbons may be disposed of and their value lost. Further, their removal and subsequent disposal may also be an extra cost on the overall refinement process.

Consequently, there is a need for a method for the isolation and removal of paraffinic hydrocarbons.

BRIEF DESCRIPTION OF THE DRAWINGS

The figures illustrate certain aspects of some of the examples of the present disclosure and should not be used to limit or define the method.

BRIEF SUMMARY OF SOME OF THE PREFERRED EMBODIMENTS

Figure 1:
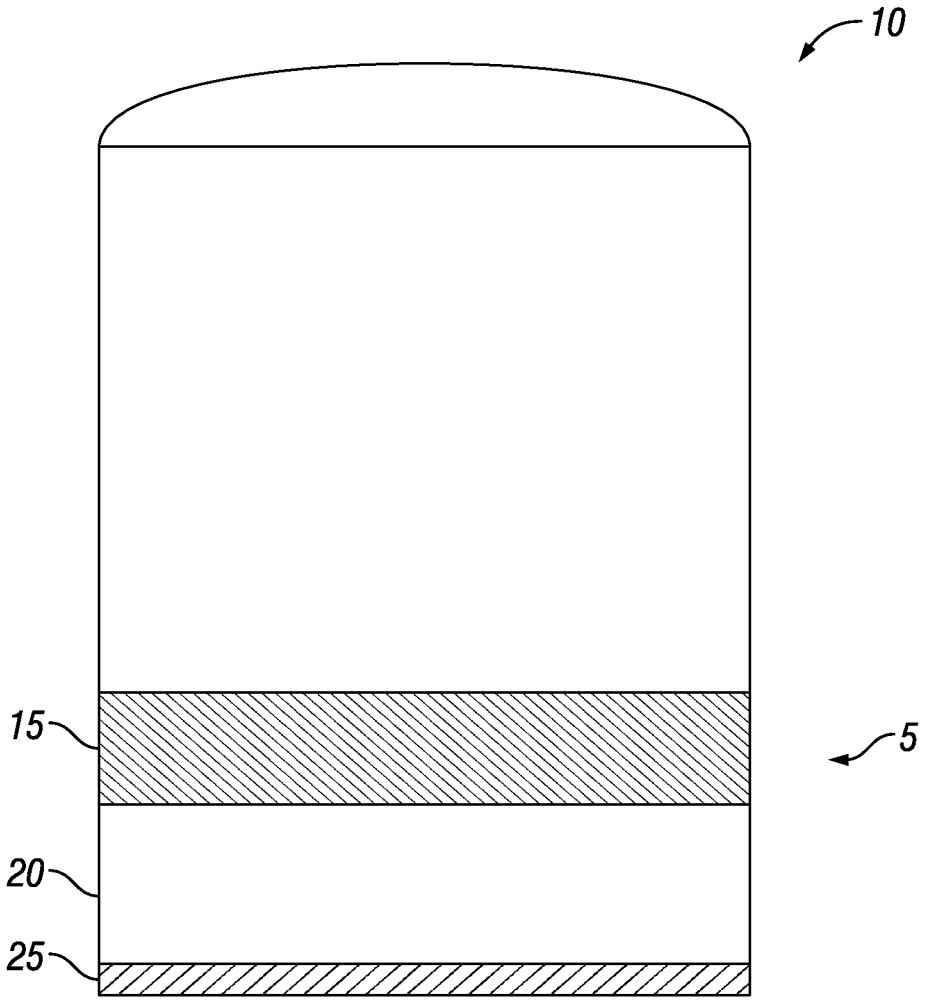
FIG. 1 illustrates a three phase separation comprising a paraffinic hydrocarbon layer, a water layer, and a layer of settled water-wet solids in accordance with certain examples.

These and other needs in the art are addressed in an embodiment by a method for isolating a paraffinic hydrocarbon layer from a sludge comprising paraffinic hydrocarbons, water, and solids. The method includes contacting the sludge with isopropylamine dodecylbenzene sulfonate, a cutter stock, and water. The isopropylamine dodecylbenzene sulfonate comprises a concentration of at least 1500 ppm. The ratio of sludge:cutter:water (i.e., sludge:cutter stock: water) is at least 4:2:1. The method also includes determining if the sludge has separated into a three phase separation comprising a paraffinic hydrocarbon layer, a water layer, and a layer of settled solids.

The foregoing has outlined rather broadly the features and technical advantages of the present invention in order that the detailed description of the invention that follows may be better understood. Additional features and advantages of the invention will be described hereinafter that form the subject of the claims of the invention. It should be appreciated by those skilled in the art that the conception and the specific embodiments disclosed may be readily utilized as a basis for modifying or designing other embodiments for carrying out the same purposes of the present invention. It should also be realized by those skilled in the art that such equivalent embodiments do not depart from the spirit and scope of the invention as set forth in the appended claims.

DETAILED DESCRIPTION

In embodiments, the method for isolation of paraffinic hydrocarbons comprises a paraffinic hydrocarbon isolation composition. Embodiments of the paraffinic hydrocarbon isolation composition comprise a mixture of a combination demulsifier and crystal modifier, surfactants, and a solvent. The combination demulsifier and crystal modifier is isopropylamine dodecylbenzene sulfonate ("IDBS"). The surfactants may be nonionic, anionic, cationic, or zwitterionic. The solvent may be any compatible light hydrocarbon. The paraffinic hydrocarbon isolation composition may be used to isolate paraffin hydrocarbons from water and solids. A "paraffin hydrocarbon" as defined herein, is a hydrocarbon having a carbon number of 18 to 36. Without limitation, the paraffinic hydrocarbon isolation composition may modify the paraffin wax crystals found in crude oil tanks, or other such equipment, such that the paraffin hydrocarbons remain fluid and do not precipitate when cooled, moreover the paraffinic hydrocarbon isolation composition may break the water-in-oil emulsion, separating the water from the paraffinic hydrocarbons and also removing any paraffinic hydrocarbons from the surface of the solids. The resulting product is a three phase separation of the paraffinic hydrocarbons, water, and the settled water-wet solids. In embodiments, the paraffinic hydrocarbon isolation composition may be used to isolate the paraffin hydrocarbons from any industrial equipment used in industrial facilities including vessels, tanks, vacuum towers, heat exchangers, piping, distillation columns, and the like. In embodiments, the paraffinic hydrocarbon isolation composition may be used to remove the paraffin hydrocarbons from any equipment used to produce, store, or transport the paraffin hydrocarbons during the processes of crude oil refinement, natural gas processing, hydrocarbon transport, hydrocarbon processing, hydrocarbon cleanup, and the like.

Embodiments of the paraffinic hydrocarbon isolation composition comprise the combination wax crystal modifier and demulsifier, IDBS. The paraffinic hydrocarbon isolation composition may have any wt. % of IDBS suitable for isolating the paraffin hydrocarbons from any water or solids present, such that as pure as possible a volume of the paraffin hydrocarbons is produced. For instance, the paraffin hydrocarbons may be removed from the surface of industrial equipment and subsequently purified by the production of a three phase separation comprising the paraffin hydrocarbons, water, and any settled water-wet solids. In an embodiment, the paraffinic hydrocarbon isolation composition has between about 0.5 wt. % IDBS and about 65.0 wt. % IDBS, alternatively between about 25.0 wt. % IDBS and about 65.0 wt. % IDBS. In some embodiments, the IDBS may comprise about 63.0 wt. % to about 65.0 wt. % of the paraffinic hydrocarbon isolation composition. With the benefit of this disclosure, one having ordinary skill in the art will be able to select an appropriate amount of IDBS to include in the paraffinic hydrocarbon isolation composition for a chosen application.

Embodiments of the paraffinic hydrocarbon isolation composition comprise one or more surfactants. The surfactants may be cationic, anionic, nonionic, zwitterionic, or any combination thereof. Examples of cationic surfactants may include, but are not limited to, quaternary ammonium salts such as an imidazole derivative, heterocycles (e.g., isostearyl ethylimidazolinium ethosulfate ("ISES"), etc.), alkyl-substituted pyridines, morpholinium salts, alkyl ammonium salts (e.g., cetyl trimethylammonium bromide, stearalkonium chloride, dimethyldioctadecylammonim chloride, etc.), the like, or any combination thereof. Examples of anionic surfactants may include, but are not limited to, carboxylates (e.g., trideceth-8 carboxylate, lauryl ether carboxylate, myristyl ether carboxylate), sulfonates (e.g., alkylbenzene sulfonate), sulfates (e.g., alkyl sulfates, alkyl ether sulfates), the like, or any combination thereof. Examples of nonionic surfactants include, but are not limited to, glycol derivatives (e.g., polyethylene glycol, methoxypolyethylene glycols), ethoxylates (e.g., alcohol ethoxylates, ethoxysulfates), the like, or any combination thereof. Examples of zwitterionic surfactants include, but are not limited to, betaines (e.g., cocamidopropyl betaine), hydroxysultaines (e.g., cocamidopropyl hydroxysultaine), amphoacetates (e.g., sodium lauroamphoacetate), the like, or any combination thereof. The surfactants may be mixed such that the paraffinic hydrocarbon isolation composition comprises multiple classes of surfactants, for example, in an embodiment, the paraffinic hydrocarbon isolation composition may comprise an anionic surfactant, a nonionic surfactant, and a zwitterionic surfactant. In a specific embodiment, the paraffinic hydrocarbon isolation composition comprises the surfactants polyethylene glycol and cocamidopropyl betaine. The total amount of surfactants may vary as desired in order to achieve the desired result. In embodiments, the total amount of surfactants in the paraffinic hydrocarbon isolation composition may include or be any value between about 0.01 wt. % to about 5 wt. %, alternatively, about 0.05 wt. % to about 3 wt. %, or further alternatively, about 0.1 wt. % to about 1 wt. %. In an embodiment, the paraffinic hydrocarbon isolation composition comprises polyethylene glycol in an amount of about 1 wt. % or less and cocamidopropyl betaine in an amount of about 0.1 wt. % or less.

When choosing surfactants, it is desirable to choose surfactants that do not interfere with the functionality of the IDBS and/or to use an amount of surfactant that does not interfere with the functionality of the IDBS. With the benefit of this disclosure, one having ordinary skill in the art will be able to select an appropriate type(s) and amount of surfactants to include in the paraffinic hydrocarbon isolation composition for a chosen application.

Embodiments of the paraffinic hydrocarbon isolation composition comprise a solvent. The solvent may be any solvent, or combination of solvents, suitable for dissolving and carrying the surfactant and IDBS. Further, it may be desirable to use a solvent that is compatible with the paraffinic hydrocarbons and any cutter stock used to dilute the "sludge," which is the mixture of the paraffinic hydrocarbons, water, and solids present in a vessel, for example, vessel 10 as illustrated on FIG. 1. Examples of solvents generally include light hydrocarbons, aliphatic hydrocarbons, or aromatic hydrocarbons. Without limitation, the solvent may include, but should not be limited to, diesel, biodiesel, cycle oil, crude oil, light sweet crude oil, the like, or a combination thereof. In embodiments, the paraffinic hydrocarbon isolation composition may include the solvent in an amount between about 30.0 wt. % solvent to about 98.0 wt. % solvent, alternatively, between about 30.0 wt. % solvent and about 50.0 wt. % solvent, or further alternatively, between about 32.0 wt. % solvent and about 35.0 wt. % solvent. With the benefit of this disclosure, one having ordinary skill in the art will be able to select an appropriate type and amount of the solvent to include in the paraffinic hydrocarbon isolation composition for a chosen application.

The paraffinic hydrocarbon isolation composition may be prepared by any suitable method. The components may be mixed in any order as desired. For example, the IDBS may be added to a surfactant and mixed, and then the solvent may be added subsequently and mixed with the IDBS and surfactant to form the paraffinic hydrocarbon isolation composition. Alternatively, the IDBS may be added to the solvent and mixed, and then one or more surfactants may be added to the IDBS and solvent and mixed. The paraffinic hydrocarbon isolation composition may be prepared at any suitable temperature or pressure, including ambient temperature and pressure. Thus, there is no preferred way to produce the paraffinic hydrocarbon isolation composition, and the proper production of the paraffinic hydrocarbon isolation composition, with the benefit of this disclosure, will be within the understanding of one of ordinary skill in the art.

In embodiments, a process for isolating the paraffinic hydrocarbons comprises contacting the sludge with the paraffinic hydrocarbon isolation composition. As used herein, "sludge" describes the mixture of the paraffinic hydrocarbons, water, and solids. The term "sludge" does not imply any particular viscosity, clarity, consistency, etc. Further, the term "sludge." does not exclude the presence of other components present in the sludge besides the paraffinic hydrocarbons, water, and solids. For example, the sludge may comprise hydrocarbons in addition to the paraffinic hydrocarbons. In embodiments, the paraffinic hydrocarbon isolation composition may be introduced into a vessel in which a sludge is disposed. The paraffinic hydrocarbon isolation composition may be introduced into the vessel by any suitable means such that the paraffinic hydrocarbon isolation composition contacts the sludge disposed therein. In embodiments, the paraffinic hydrocarbon isolation composition is poured, pumped, injected, the like, or any combination thereof in the vessel. As an example, in some embodiments, the paraffinic hydrocarbon isolation composition is injected into a vessel via a pressurized injection. For example, the paraffinic hydrocarbon isolation composition may be injected into the vessel with a pressure at a flow rate of about 1,000 gpm to about 3,500 gpm, alternatively, at about 2,650 gpm to about 3,350 gpm, or further alternatively, at about 2,800 gpm to about 3,200 gpm. With the benefit of this disclosure, one having ordinary skill in the art will be able to select an appropriate injection method for the paraffinic hydrocarbon isolation composition for a chosen application.

As discussed above, embodiments of the paraffinic hydrocarbon isolation composition may be used to produce a three phase separation of paraffinic hydrocarbons, water, and settled water-wet solids. FIG. 1 illustrates an example of a three phase separation 5. The three phase separation 5 is disposed within a vessel 10, for example, a crude oil tank. In the three phase separation 5, the paraffinic hydrocarbon layer 15 is disposed above the water layer 20. Any settled water-wet solids 25 may be disposed beneath the water layer 20. In embodiments, the three phase separation 5 is produced by contacting a sludge mixture comprising the paraffinic hydrocarbons, water, and solids. Heat may be added to help liquefy the sludge so that the paraffinic hydrocarbon isolation composition may be circulated throughout the sludge. Without limitation by theory, the IDBS as a dual function wax crystal modifier and demulsifier, modifies paraffin wax crystal formation so that when the IDBS has been thoroughly circulated amongst the sludge, the paraffin hydrocarbons may not recrystallize even when cooled to below the wax precipitation temperature.

Once a three phase separation 5 has been produced, the paraffinic oil layer 15 may be removed. In some embodiments, it may be desired to drain the water layer 20 or to add water to the water layer 20 such that the paraffinic oil layer 15 is positioned such that a means for removal, for example, a drain, suction valve, etc. may be positioned adjacent to the paraffinic oil layer 15. When draining the water layer 20 or adding to the water layer 20, it may be desirable to not disturb the interface between the water layer 20 and the paraffinic oil layer 15 as this may result in unwanted mixing between the separated layers.

In embodiments, heat may be applied to the paraffinic hydrocarbon isolation composition and/or the sludge containing the paraffinic hydrocarbons. In embodiments, and without limitation by theory, the heat may be used to liquefy (i.e., reduce the viscosity of) the sludge so that the paraffinic hydrocarbon isolation composition may be more easily circulated amongst it. The heat may be applied by steam, boiler and heat exchanger, heated coils, or the like. In embodiments, using steam, the steam may be at any sufficient temperature. In embodiments, and without limitation, enough heat is applied to raise the temperature to the melting point of the paraffinic hydrocarbons in the sludge. In an embodiment, the amount of heat applied is between about 35° C. to about 80° C. In some alternative embodiments, the amount of heat applied is between about 40° C. to about 70° C. In further alternative embodiments, the amount of heat applied is between about 40° C. to about 60° C. The heat may also be applied to the paraffinic hydrocarbon isolation composition prior to the paraffinic hydrocarbon isolation composition contacting the sludge or concurrently while the paraffinic hydrocarbon isolation composition is contacting the sludge. In embodiments using steam, the steam may be applied at any sufficient pressure, for example, the steam may be applied at a pressure between about 50 psig to about 250 psig, alternatively, 100 psig to about 200 psig, or further alternatively, about 100 psig to about 150 psig. With the benefit of this disclosure, one having ordinary skill in the art will be able to heat the paraffinic hydrocarbons to a desired temperature for a chosen application.

As discussed above, proper circulation may be important in treating the sludge (i.e., to produce a three phase separation 5) as it may be desirable to mix the paraffinic hydrocarbon isolation composition thoroughly with the sludge so as to modify the wax crystal formation potential of as much of the paraffinic hydrocarbons as can be achieved and also to break any water-in-oil or oil-in-water emulsions which may form so as to produce as clean a three phase separation 5 as possible. The circulated paraffinic hydrocarbon isolation composition may be circulated in the tank using any sufficient method to distribute the paraffinic hydrocarbon isolation composition throughout and amongst the sludge as evenly as possible. Once a proper temperature is achieved, the vessel 10 contents (including the sludge and the paraffinic hydrocarbon isolation composition) may be circulated in an amount between about ten vessel volumes to about thirty vessel volumes. For example, the vessel 10 contents may be circulated in an amount between about ten vessel volumes to about twenty vessel volumes, or alternatively, about ten vessel volumes to about fifteen vessel volumes. Once the desired amount vessel volumes have been recirculated: recirculation, heat, and any agitation may be halted so as to allow the phases to separate into the three phase separation 5. With the benefit of this disclosure, one having ordinary skill in the art will be able to circulate the volume of vessel 10 a sufficient amount for a chosen application.

In embodiments, the paraffinic hydrocarbon isolation process may include the use of a cutter. The cutter may be used to reduce the viscosity of the sludge through dilution. The cutter may be any light sweet oil with an API gravity of 30 or greater. Without limitation, for example, the cutter may be light cycle oil, diesel, light sweet crude oil, the like, or any combination thereof. In some embodiments, the cutter may be the same as the solvent used in the paraffinic hydrocarbon isolation composition. The cutter may be added to the sludge in any ratio. For example, the cutter may be added to the sludge in a sludge:cutter:water ratio of about 4:2:1, where the water represents the total water in the tank including water emulsified with the sludge and any added water which may not be emulsified with sludge. Alternatively, the cutter may be added in a sludge:cutter:water ratio of about 4:4:1 or alternatively a sludge:cutter:water ratio of about 2:2:1. With the benefit of this disclosure, one having ordinary skill in the art will be able to add an appropriate amount of cutter to reduce the viscosity of the sludge a sufficient amount.

Figure 2:
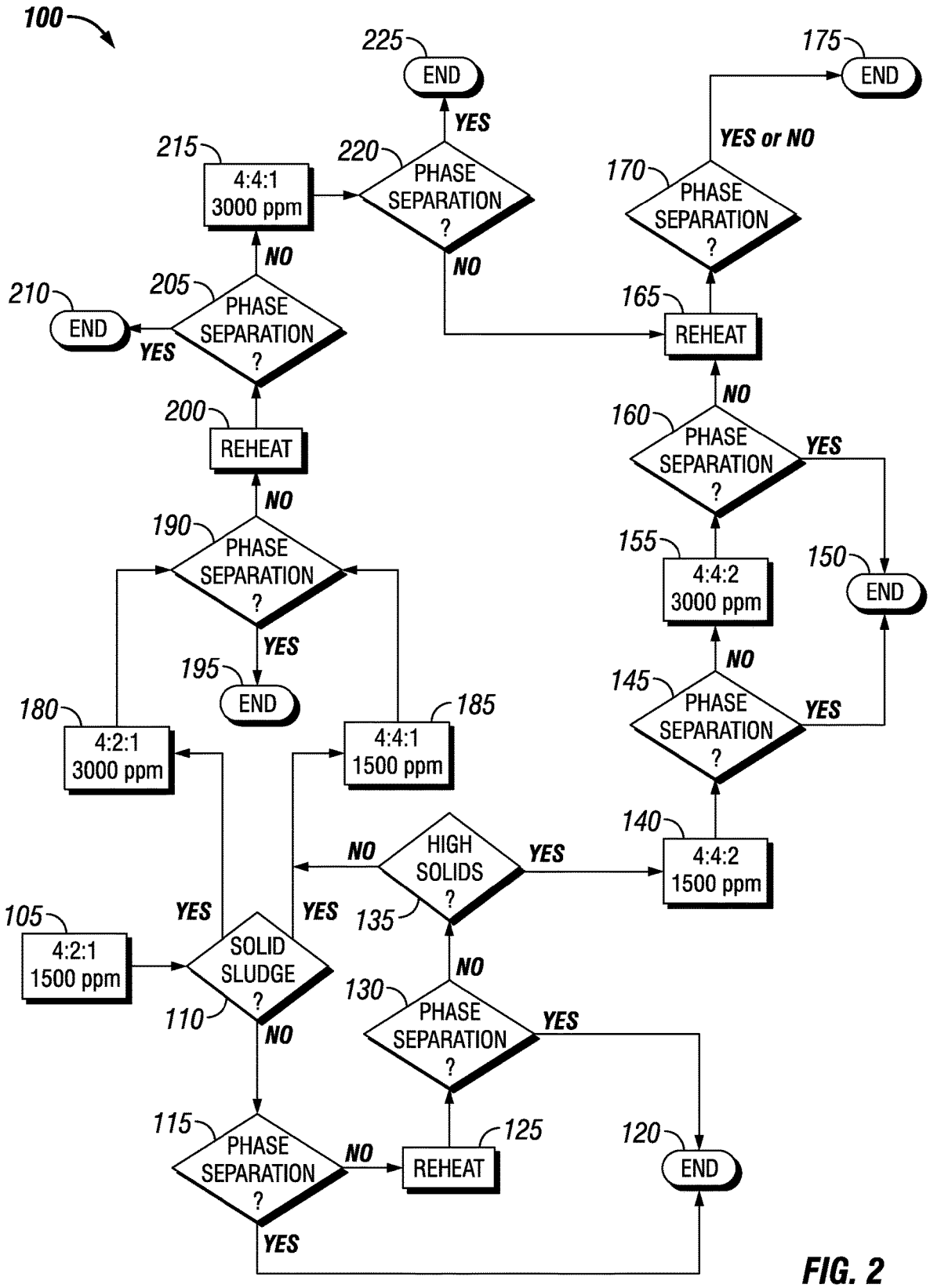
FIG. 2 illustrates a flowchart for optimization of the process for isolating paraffinic hydrocarbons from water and solids in accordance with certain examples.

In embodiments, the economical and practical use of a method for isolation of paraffinic hydrocarbons may comprise the optimization of the sludge:cutter:water ratio and the optimization of the concentration of the IDBS. FIG. 2 illustrates a flowchart for the optimization of the use of the paraffinic hydrocarbon isolation composition. It is to be understood that the optimization process depicted by FIG. 2 is to be performed on experimental samples obtained from the vessel 10 in which treatment is desired. The samples may be obtained directly from the vessel 10 if desired. In embodiments, care may be taken to obtain representative samples that reflect, as close as possible, the entire contents of the vessel 10. It may be desirable to obtain samples from multiple access points and multiple depths. Further, it may be desirable to circulate the contents of vessel 10 prior to obtaining a sample. Multiple samples may be obtained in the event that the standard protocol requires modification in order to achieve optimization, as well as to repeat the sample testing process to obtain an average of results.

The optimization process 100 may be initiated with the testing of a collected sample at the step indicated by block 105. The sample testing step at block 105 utilizes a sludge:cutter:water ratio of about 4:2:1 and the concentration of the IDBS is approximately 1500 ppm, alternatively the concentration of the IDBS is from about 1.000 ppm to about 2.000 ppm. As described above, the IDBS may be mixed with a solvent and one or more surfactants. The solvent may be the same or different from the cutter stock. The paraffinic hydrocarbon isolation composition and the sample are mixed thoroughly, for example, by using a magnetic stir bar set at a rate sufficient to create a vortex within the sample container. The sample may be heated, for example, to a temperature greater than the melting point of the paraffinic hydrocarbons (e.g., a temperature between about 40° C. to about 80° C.). The sample may be stirred and heated for approximately an hour, alternatively from about 30 minutes to about two hours. The sample may then be removed from the heat source and agitation/stirring stopped. The sample may be allowed to sit until a water layer (e.g., water layer 20 as described in FIG. 1) has appeared. Once a water layer has appeared a "Basic Sediment and Water Test," as described below, may be used to measure the purity of the three phase separation (e.g., three phase separation 5, as illustrated in FIG. 1).

In embodiments, the purity of a three phase separation may be measured by lab testing. For example, a "Basic Sediment and Water Test" ("BS&W") as described by ASTM D1796-11 el may be used to measure the purity of the paraffinic hydrocarbon layer. For example, a volume of organic solvent, for example toluene, may be placed in a centrifuge tube. A volume of the paraffinic hydrocarbon layer equal in volume to the volume of the organic solvent may subsequently be added to the centrifuge tube. After mixing the contents, the centrifuge tube may then be placed in a centrifuge and counterbalanced. The centrifuge tube may then be centrifuged for a sufficient amount of time to allow for phase separation. For example, the centrifuge tube may be centrifuged for about 15 minutes at a centrifugal speed of 1,250 rpm or greater. After centrifugation, the centrifuge tube may be removed and the volume of each individual layer (e.g., the paraffinic hydrocarbon layer 15, the water layer 20, and the layer of settled water-wet solids 25 as illustrated in FIG. 1) may be determined. The BS&W percentage in the removed sample obtained from the paraffinic hydrocarbon layer may then be determined according to the following equation:

$$BS\&W(\%)=[(mL\text{water}+mL\text{settled solids})/mL\text{total sample}]\times 100 \quad \text{(eq. 1)}$$

In embodiments, the paraffinic hydrocarbon layer may be 95% pure or greater, which refers to the paraffinic hydrocarbon layer having a BS&W percentage of 5% or less. In alternative embodiments, the paraffinic hydrocarbon layer 15 may be 98% pure or greater (i.e. BS&W percentage of 2% or less). In further alternative embodiments, the paraffinic hydrocarbon layer 15 may be 99% pure of greater (i.e. BS&W percentage of 1% or less). The BS&W test may be used in the optimization process 100 to determine the optimal sludge:cutter:water ratio and concentration of the IDBS to produce a three phase separation with a desired purity. The BS&W test may also be used to measure the purity of the full-scale completed process in a vessel (e.g., vessel 10 as illustrated in FIG. 1) in order to determine if the purity of the isolated paraffinic hydrocarbon layer is sufficient for the desirable downstream application.

With continued reference to FIG. 2, if the sludge remains solid or if there is no three phase separation, additional modifications to the chemistry and/or the concentration of the paraffinic hydrocarbon isolation composition may be made. Diamond 110 is an evaluation of the status of the sludge. Specifically, diamond 110 is a visual and/or tactile check to determine if the sludge is solid after the one hour reaction period (alternatively from about 30 minutes to about two hours) discussed above at the sample testing step indicated by block 105. If the sludge is not solid, the optimization process 100 proceeds to a determination of phase separation indicated by diamond 115. If the sludge is solid, parallel testing samples are tested under two different conditions as will be discussed below.

Diamond 115 is a visual determination of a three phase separation (e.g., three phase separation 5 in FIG. 1). At the process step indicated by diamond 115, the sample is inspected for the presence of a water layer, a paraffinic hydrocarbon layer, and also the potential presence of a settled water-wet solids layer. If a three phase separation is present, the BS&W test, as described above, may be performed to determine if the three phase separation has achieved the desired level of purity. If the desired level of purity is achieved, the testing is complete and the sludge: cutter:water ratio of 4:2:1 and IDBS concentration of approximately 1500 ppm (alternatively from about 1,000 ppm to about 2,000 ppm) may be used for full scale isolation of the paraffinic hydrocarbons in vessel 10, this is represented by oval 120 signifying the end of sample testing.

Continuing from diamond 115, if a three phase separation is not achieved, it may be desirable to reheat the reaction as indicated by a reheating step noted by box 125. The test sample may be reheated for another reaction period of approximately an hour, alternatively from about 30 minutes to about two hours. After the reheating time, another phase separation determination is performed as indicated by diamond 130. The phase separation determination at diamond 130 is identical to the phase separation determination at diamond 115. If phase separation is achieved, a BS&W test may be performed as described above. If a phase separation is not achieved, the amount of solids is measured as indicated by a solids measurement test at diamond 135. In an embodiment a high solids level may be determined by the BS&W test that is performed at the beginning of the process on the as-received sludge sample. If a large amount of solids are present, the volumes of cutter stock and water are doubled and the ratio of the sludge:cutter:water is adjusted to 4:4:2 while maintaining the concentration of IDBS at 1500 ppm (alternatively from about 1,000 ppm to about 2,000 ppm). As described above, the IDBS may be mixed with a solvent and one or more surfactants. The solvent may be the same or different from the cutter stock. Testing with a new sample is initiated at these parameters, as indicated by the sample testing step at box 140. The testing process is identical to that described above in regards to box 105. After testing, another phase separation determination is performed as noted by diamond 145. If phase separation is achieved, a BS&W test may be performed on the recovered hydrocarbon as described above. If the desired purity is achieved, testing is complete and the sludge:cutter:water ratio of 4:4:2 and IDBS concentration of approximately 1500 ppm (alternatively from about 1,000 ppm to about 2,000 ppm) may be used for full scale isolation of the paraffinic hydrocarbons in vessel 10; this is represented by oval 150 signifying the end of sample testing. If there is no phase separation or the desired level of purity is not reached, the level of IDBS may be doubled as indicated by the sample testing step at box 155, which uses a sludge:cutter:water ratio of about 4:4:2 and an IDBS concentration of approximately 3000 ppm, alternatively from about 3,000 ppm to about 5,000 ppm. As described above, the IDBS may be mixed with a solvent and one or more surfactants. The solvent may be the same or different from the cutter stock. Testing with a new sample is initiated at these parameters. The reaction conditions are identical to those of the sample testing steps as boxes 105 and 140. After the reaction has completed, another phase separation determination, illustrated by diamond 160, is performed. If phase separation is achieved, a BS&W test may be performed on the recovered hydrocarbon as described above, and if the desired purity is achieved, the sample testing is concluded and a sludge:cutter:water ratio of about 4:4:2 and IDBS concentration of approximately 3000 ppm (alternatively from about 3,000 ppm to about 5.000 ppm) may be used for full scale isolation of the paraffinic hydrocarbons in vessel 10; this is represented by oval 150 signifying the end of sample testing. If phase separation is not achieved, it may be desirable to reheat the sample as indicated by box 165, which denotes a reheating operation. The sample may be reheated for another reaction period of approximately an hour, alternatively from about 30 minutes to about two hours. After the reaction time, another phase separation determination is performed, illustrated by diamond 170. This phase separation determination is identical in practice to the phase separation determinations of earlier steps. If phase separation is achieved, a BS&W test may be performed on the recovered hydrocarbon as described above, and if the desired purity is achieved, the testing is complete and a sludge:cutter:water ratio of about 4:4:2 and IDBS concentration of approximately 3000 ppm (alternatively from about 3,000 ppm to about 5,000 ppm) may be used for full scale isolation of the paraffinic hydrocarbons in vessel 10; this represented by oval 175 signifying the end of sample testing. If a phase separation is not achieved, the use of the paraffinic hydrocarbon isolation composition is not appropriate for isolation of the paraffinic hydrocarbons within vessel 10, and treatment may not be performed. The optimization process is therefore concluded and no optimization is possible; this is represented by oval 175 signifying the end of sample testing.

With reference to the process step represented by diamond 110, and as discussed above, should the sludge remain solid after testing at a sludge:cutter:water ratio of about 4:2:1 and an IDBS concentration of approximately 1500 ppm (alternatively from about 1,000 ppm to about 2,000 ppm); parallel sample testing is to be conducted. One sample is to be tested at double the amount of IDBS while maintaining a sludge:cutter:water ratio of about 4:2:1. This sample testing is noted by box 180. The other sample is to be tested at double the amount of cutter while maintaining the IDBS at 1500 ppm (alternatively from about 1,000 ppm to about 2,000 ppm), and this sample testing is noted by box 185. As described above, the IDBS may be mixed with a solvent and one or more surfactants. The solvent may be the same or different from the cutter stock. Further, the sample testing step at box 185 is also the process step if the level of solids, as measured during the solids measurement step indicated by diamond 135, is determined to be normal. After the reactions have completed, another phase separation determination at diamond 190 is performed for each sample. The phase separation determination at step 190 is identical to the phase separation determinations at the steps indicated by diamonds 115, 130, 145, etc. If phase separation is achieved for either sample, a BS&W test may be performed on the recovered hydrocarbon as described above. If the desired purity is achieved, the testing is complete, and the respective sludge:cutter:water ratio and IDBS concentration (i.e. either 4:2:1 and 3000 ppm, alternatively from about 3.000 ppm to about 5.000 ppm, or 4:4:1 and 1500 ppm, alternatively from about 1.000 ppm to about 2.000 ppm) may be used for full scale isolation of the paraffinic hydrocarbons in vessel 10. This is represented by oval 195 signifying the end of sample testing. If phase separation is not achieved, it may be desirable to reheat both of the samples as indicated by box 200 for another reaction period of approximately an hour, alternatively from about 30 minutes to about two hours. After the reaction time, another phase separation determination is performed as indicated by diamond 205. If phase separation is achieved, a BS&W test may be performed on the recovered hydrocarbon as described above. If the desired purity is achieved, the respective sludge:cutter:water ratio and IDBS concentration (i.e. either 4:2:1 and 3000 ppm, alternatively from about 3,000 ppm to about 5,000 ppm, or 4:4:1 and 1500 ppm, alternatively from about 1,000 ppm to about 2,000 ppm) may be used for full scale isolation of the paraffinic hydrocarbons in vessel 10. This is represented by oval 210 signifying the end of sample testing. If there is no phase separation or the desired level of purity is not reached, a new sample is prepared and tested as indicated by the sample testing process noted by box 215, which uses a sludge:cutter:water ratio of about 4:4:1 and an IDBS concentration of approximately 3000 ppm (alternatively from about 3,000 ppm to about 5,000 ppm). As described above, the IDBS may be mixed with a solvent and one or more surfactants. The solvent may be the same or different from the cutter stock. After the reaction time, another phase separation determination is performed as indicated by diamond 220. If phase separation is achieved, a BS&W test may be performed on the recovered hydrocarbon as described above, and if the desired purity is achieved, the respective sludge:cutter:water ratio of 4:4:1 and IDBS concentration of 1500 ppm (alternatively from about 1,000 ppm to about 2,000 ppm) may be used for full scale isolation of the paraffinic hydrocarbons in vessel 10. This is represented by oval 225 signifying the end of sample testing. If phase separation is not achieved, it may be desirable to reheat the reaction as indicated by box 165 for another reaction period of approximately an hour, alternatively from about 30 minutes to about two hours. After the reaction time, another phase separation determination is performed as indicated by diamond 170. If phase separation is achieved, a BS&W test may be performed on the recovered hydrocarbon as described above, and if the desired purity is achieved, the testing is complete and a sludge:cutter:water ratio of about 4:4:1 and IDBS concentration of approximately 3000 ppm (alternatively from about 3,000 ppm to about 5,000 ppm) may be used for full scale isolation of the paraffinic hydrocarbons in vessel 10. This is represented by oval 175 signifying the end of sample testing. If a phase separation is not achieved, the use of the paraffinic hydrocarbon isolation composition is not appropriate for isolation of the paraffinic hydrocarbons within vessel 10, and treatment may not be performed. The optimization process is therefore concluded. This is represented by oval 175 signifying the end of sample testing.

The production of the three phase separation 5 may take any suitable period of time to complete. In embodiments, the three phase separation 5 may take as long a period of time as it takes to recirculate the desired amount of volumes of the vessel, for example, vessel 10. For example, if a three phase separation 5 uses a ten vessel volume recirculation for the desired separation, the time period to produce the three phase separation 5 is the time desired to complete the ten volume vessel recirculation. As a result, the period of time sufficient to produce the three phase separation 5 may be dependent upon the size and shape of the vessel, the volume of sludge within the vessel, the recirculation equipment used to recirculate the vessel volume, etc. Further, in addition to the time to recirculate the vessel volume, additional time may be desired to allow any of the solids, which may be present within the sludge, to settle. In particular, sufficient time may be provided for the solids to settle out of the paraffinic hydrocarbon layer 15. With the benefit of this disclosure, one having ordinary skill in the art will be able to recognize the appropriate amount of time to apportion for a chosen application.

In optional embodiments, once the paraffinic hydrocarbons have been removed, the water in the water layer 20 may be removed and disposed of, for example, at a water treatment facility. The settled water-wet solids 25 may also be removed and disposed at any facility sufficient for the removal of this class of solids. With the benefit of this disclosure, one having ordinary skill in the art will be able to remove the remaining water and solids from a vessel, for example, vessel 10 in FIG. 1 and dispose of the remaining water and solids as appropriate.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited. In the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Although individual embodiments are discussed, the invention covers all combinations of all those embodiments. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present invention. If there is any conflict in the usages of a word or term in this specification and one or more patent(s) or other documents that may be incorporated herein by reference, the definitions that are consistent with this specification should be adopted.

What is claimed is:

1. A method for determining a paraffinic hydrocarbon isolation composition ratio, the method comprising:

(A) contacting a sludge comprising paraffinic hydrocarbons, water, and solids disposed within a vessel, with isopropylamine dodecylbenzene sulfonate, a cutter stock, and water thereby producing a sludge mixture, wherein step (A) occurs at a high temperature between 35° C. and 80° C., wherein the isopropylamine dodecylbenzene sulfonate is present at a concentration of at least 1500 ppm, wherein a volume ratio of sludge:cutter stock:water is at least 4:2:1, and wherein the cutter stock comprises a light sweet oil with an American Petroleum Institute (API) gravity of 30 or greater, a light cycle oil, a diesel oil, a light sweet crude oil, or combinations thereof;

(B) circulating the sludge mixture to maximize wax crystal formation of the paraffinic hydrocarbons and to break any water-in-oil or oil-in-water emulsions which may form so as to produce as clean a three phase separation as possible;

(C) determining if the sludge mixture has separated into a three phase separation within the vessel, wherein step (C) occurs at a temperature lower than the high temperature of step (A), and wherein the three phase separation comprises a paraffinic hydrocarbon layer, a water layer, and a layer of settled solids by way of viewing the sludge mixture to determine if three distinct phases are present;

(D) thereafter, if the sludge mixture has not separated into the three phase separation, reheating the sludge mixture to the high temperature for a period, increasing or decreasing the concentration of isopropylamine dodecylbenzene sulfonate, increasing or decreasing the volume ratio of sludge:cutter stock:water, or any combinations thereof until the sludge mixture separates into the three phase separation within the vessel; and (E) testing to measure an amount of settled solids present in the paraffinic hydrocarbon layer within the vessel.

2. The method of claim 1, wherein if the sludge mixture has not separated into the three phase separation, the concentration of isopropylamine dodecylbenzene sulfonate is increased to at least 3000 ppm.

3. The method of claim 1, wherein if the sludge mixture has not separated into the three phase separation, the volume ratio of sludge:cutter stock:water is adjusted to at least 4:4:1.

4. The method of claim 3, further comprising determining if the sludge mixture has separated into the three phase separation comprising a paraffinic hydrocarbon layer, a water layer, and a layer of settled solids after adjustment of the volume ratio of sludge:cutter stock:water to at least 4:4:1.

5. The method of claim 4, wherein if the sludge mixture has not separated into the three phase separation, the concentration of isopropylamine dodecylbenzene sulfonate is increased to at least 3000 ppm.

6. The method of claim 1, wherein if the sludge mixture has not separated into the three phase separation, the volume ratio of sludge:cutter stock:water is adjusted to at least 4:4:2.

7. The method of claim 6, further comprising determining if the sludge mixture has separated into the three phase separation comprising a paraffinic hydrocarbon layer, a water layer, and a layer of settled solids after adjustment of the volume ratio of sludge:cutter stock:water to at least 4:4:2.

8. The method of claim 7, wherein if the sludge mixture has not separated into the three phase separation, the concentration of isopropylamine dodecylbenzene sulfonate is increased to at least 3000 ppm.

9. The method of claim 1, wherein the volume ratio of sludge:cutter stock:water is at least 4:4:1, and the concentration of isopropylamine dodecylbenzene sulfonate is at least 3000 ppm.

10. The method of claim 1, wherein the volume ratio of sludge:cutter stock:water is at least 4:4:2, and the concentration of isopropylamine dodecylbenzene sulfonate is at least 3000 ppm.

11. The method of claim 1, wherein if the sludge mixture has separated into the three phase separation, removing the paraffinic hydrocarbon layer from contact with the water layer and the layer of settled solids.

12. The method of claim 1, further comprising performing the Basic Sediment and Water Test of American Society for Testing and Materials (ASTM)D1796 on a recovered hydrocarbon resulting from the three phase separation.

13. The method of claim 12, wherein the basic sediment and water percentage of the paraffinic hydrocarbon layer is less than 5%, as measured by Basic Sediment and Water Test of American Society for Testing and Materials (ASTM) D1796.

14. The method of claim 1, further comprising heating the sludge mixture after contacting the sludge with the isopropylamine dodecylbenzene sulfonate, the cutter stock, and the water.

15. The method of claim 1, wherein a surfactant is added to the isopropylamine dodecylbenzene sulfonate.

16. The method of claim 15, wherein the surfactant comprises two or more surfactants.

17. The method of claim 16, wherein one of the surfactants is a zwitterionic surfactant, and the other surfactant is a nonionic surfactant.

18. The method of claim 1, wherein the paraffinic hydrocarbon comprises a hydrocarbon of 18 to 34.

* * * * *